US006346554B1

(12) United States Patent
Dostie et al.

(10) Patent No.: US 6,346,554 B1
(45) Date of Patent: Feb. 12, 2002

(54) ASA SIZE EMULSIFICATION WITH A NATURAL GUM FOR PAPER PRODUCTS

(75) Inventors: Daniel R. Dostie, McDonald; Roman J. Nowicki, Bethlehem, both of PA (US)

(73) Assignee: Calgon Corporation, Naperville, IL (US)

( * ) Notice: Subject to any disclaimer, the term of this patent is extended or adjusted under 35 U.S.C. 154(b) by 0 days.

(21) Appl. No.: 09/601,801

(22) PCT Filed: Apr. 6, 1999

(86) PCT No.: PCT/US99/07651

§ 371 Date: Jan. 18, 2001

§ 102(e) Date: Jan. 18, 2001

(87) PCT Pub. No.: WO99/51816

PCT Pub. Date: Oct. 14, 1999

Related U.S. Application Data

(60) Provisional application No. 60/080,862, filed on Apr. 6, 1998.

(51) Int. Cl.[7] ..... B01F 17/00; D21H 19/00

(52) U.S. Cl. ..... 516/72; 516/100; 162/158; 162/175; 162/183; 162/179; 162/322

(58) Field of Search ..... 162/158, 175, 162/183, 179, 322; 516/100, 72

(56) References Cited

U.S. PATENT DOCUMENTS

| | | | | |
|---|---|---|---|---|
| 3,102,064 A | * | 8/1963 | Wurzburg et al. | 162/158 |
| 4,657,946 A | | 4/1987 | Rende et al. | |
| 5,176,748 A | * | 1/1993 | Nikoloff et al. | 106/211 |
| 5,658,378 A | * | 8/1997 | Tsai et al. | 106/207.2 |
| 5,853,542 A | | 12/1998 | Bottorff | |
| 5,876,562 A | * | 3/1999 | Johannson | 162/158 |
| 5,962,555 A | * | 10/1999 | Glover | 523/411 |
| 5,969,011 A | * | 10/1999 | Frolich et al. | 524/35 |
| 6,093,217 A | * | 7/2000 | Frolich et al. | 8/115.6 |

* cited by examiner

*Primary Examiner*—Jill Warden
*Assistant Examiner*—Monique T. Cole
(74) *Attorney, Agent, or Firm*—Margaret M Brumm; Thomas M. Breininger

(57) ABSTRACT

A natural gum is used to provide emulsification of alkenyl succinic anhydride (ASA) sizing agents for paper products. The natural gum can be nonionic, cationic, anionic, amphoteric, oxidized, derivatized or modified. The alkenyl succinic anhydride size emulsion formed with the natural gum improves stability and the film formed is evenly distributed, thereby promoting more uniform sizing of the paper product. The ratio of the ASA to natural gum in the emulsion ranges from 0.01:1 to 100:1, and preferably 0.1:1 to 20:1. The amount of ASA size is 1 lb./ton to 10 lbs./ton of finished paper product. A surfactant may be used to further improve the stability of the emulsion.

4 Claims, 1 Drawing Sheet

Figure 1. Chemical Stability of ASA Emulsions
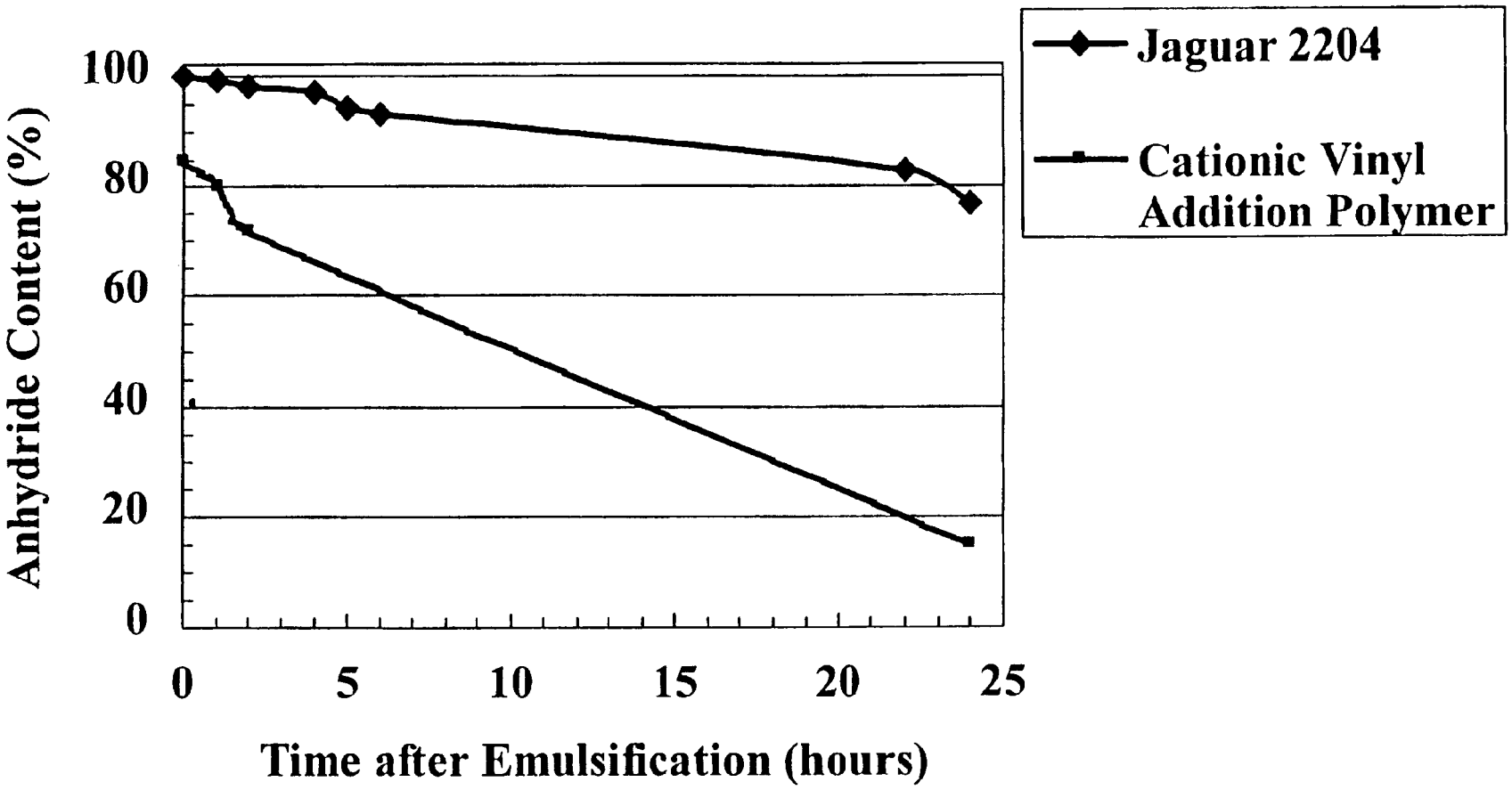

ASA SIZE EMULSIFICATION WITH A NATURAL GUM FOR PAPER PRODUCTS

CROSS REFERENCE TO RELATED APPLICATION

This application claims the priority of U.S. Provisional patent application Serial No: 60/080,862 entitled "ASA SIZE EMULSIFICTION WITH A NATURAL GUM FOR PAPER PRODUCTS" filed on APR. 6, 1998.

FIELD OF THE INVENTION

This invention relates to the use of a natural gum for the emulsification of alkenyl succinic anhydrides (ASA) sizing agents in the manufacture of paper products. The natural gum may be nonionic, cationic, anionic, amphoteric, oxidized, derivatized, or otherwise modified.

BACKGROUND OF THE INVENTION

Alkenyl succinic anhydrides (ASA) useful in the sizing of cellulosic materials have gained considerable commercial success. These materials were first fully disclosed in U.S. Pat. No. 3,102,064 which is hereinafter incorporated by reference. This patent discloses a certain class of chemical materials generally having the structural formula:

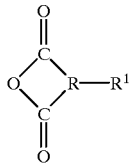

wherein R represents a dimethylene or trimethylene radical, and wherein $R^1$ is a hydrophobic group containing more than 5 carbon atoms which may be selected from the group consisting of alkyl, alkenyl, aralkyl or aralkenyl groups.

In describing the use of the ASA sizes disclosed in this reference, the patentee indicates that for effective utilization, the sizing agents must be used in conjunction with a material which is either cationic in nature or is, on the other hand, capable of ionizing or disassociating in such a manner to produce one or more cations or other positively charged groups. The cationic agents as they are defined in this reference are disclosed as "alum, aluminum chloride, long chain fatty amines, sodium aluminate, polyacrylamide, chromic sulfate, animal glue, cationic thermosetting resins and polyamide polymers". The patentee particularly points out as preferred cationic agents various cationic starch derivatives including primary, secondary, tertiary, or quaternary amine starch derivatives and other cationic nitrogen substituted starch derivatives, as well as cationic sulfonium and phosphonium starch derivatives. Such derivatives, as stated by the patentee, may be prepared from all types of starches including corn, tapioca, potato, etc.

With the growing commercial use of sizes of the type above described, serious problems have remained in the application of the sizes to paper stock or pulp prior to its formation into sheet or other useful forms. Part of the problem has been that the ASA sizing materials are not water soluble, and must, accordingly, be emulsified prior to application. This allows the water insoluble size to be dispersed in the pulp, thus distributed more evenly along the cellulosic fibers, and thus creating the desired effect on the final product.

Another problem is that the use of cationic starches and/or other high molecular weight cationic polymers cause the formation of machine deposits and accompanying runnability problems in the form of press picking, felt filling, and poor cylinder vat consistency control.

While the cationic agents disclosed in U.S. Pat. No. 3,102,064 have met with some success, there has been a need within the paper industry to produce a more effective "emulsifying agent" for ASA sizes to avoid the deposit problems and felt filling problems mentioned above. In addition, such an emulsifying agent would preferably aid in the retention of the size on the fiber, and would increase, where desired, the wet and/or dry strength of the final sheet material.

U.S. Pat. No. 4,657,946 attempts to overcome some of the disadvantages of U.S. Pat. No. 3,102,064. This reference, U.S. Pat. No. 4,657,946, discloses the use of a cationically charged water soluble vinyl addition polymer with a surfactant for providing emulsification of alkenyl succinic anhydride sizing agents. The ASA formulation of this reference comprises a cationic water soluble vinyl addition polymer, ASA, a surfactant, and water. The ASA size formulation of this reference is said to obtain superior sizing results and retention results while minimizing or eliminating paper machine deposits, felt filling, and press picking.

While this ASA size formulation of U.S. Pat. No. 4,657,946 has met with some success, particularly with regard to superior ink holdout properties of the paper products, there is still a need within the paper industry to provide a more effective ASA size formulation where the emulsion is more stable when compared to the ASA size formulation of the prior art. U.S. Pat. No. 4,657,946 also requires a high ratio of vinyl addition polymer to ASA size for effective emulsification. A more efficient and cost effective emulsifying agent is desired by the industry.

SUMMARY OF THE INVENTION

Now in accordance with an embodiment of the present invention, an ASA size formulation for an emulsion for a paper product is provided which consists of water, alkenyl succinic anhydride JASA), a natural gum, and optionally, a surfactant. The natural gum may be a nonionic gum, a cationic gum, an anionic gum, an amphoteric gum, an oxidized gum, a derivatized gum or otherwise modified gum. Preferably, in an embodiment of the invention, the natural gum comprises a natural or derivatized guar gum. The minimum molecular weight for a guar gum used in the invention may be greater than 5,000 amu, and perhaps, greater than 50,000 amu. The upper molecular weight for the natural gum used in the invention generally will be constrained by its natural composition. It is not the intention of the inventors to restrict the invention based on molecular weight.

The ratio of the natural gum to the ASA can range from about 0.01:1 to about 100:1, and preferably this ratio range is from about 0.01:1 to about 20:1.

It is accordingly an object of the invention to provide an improved ASA size emulsion comprising water, alkenyl succinic anhydride (ASA), optionally a surfactant, and a natural gum, whereby the natural gum is such that it enhances the performance of the ASA by one or all of the following mechanisms: 1) increasing the retention of the size by the fiber; 2) creating a more even film to be distributed on the fiber; 3) decreasing deposits; and 4) improving the physical and chemical stability of ASA size formulation when stored and/or prior to the ASA size formulation being fed to the stock slurry. The improved ASA emulsion is also more hydrolytically stable than the ASA emulsions of the prior art.

Physical stability of the ASA emulsion is aided by small emulsion droplets that are stabilized or hindered from coalescence. Larger, and therefore fewer, particles do not spread as evenly along the cellulose fibers. Chemical stability generally refers to the resistance of the emulsified ASA to hydrolysis of the anhydride to acid form. The hydrolysis product of ASA is considered, in general, not to be an effective sizing agent.

A further object of the invention is the use of a natural gum as an additive and an emulsifying agent for ASA size for a paper product, i.e., paper and paper board thereby stabilizing the emulsified mixture so that the mixture may be stored for long periods of time prior to the emulsified mixture being fed into a pulp slurry in a paper machine during a paper making process. The improved ASA size emulsion, preferably, is very stable and more resistant to hydrolysis of the ASA size compared to the ASA size emulsions of the prior art.

In addition to a natural gum, the invention provides for the addition of a surfactant or other emulsifying agent to the ASA size formulation to further enhance the effect of the natural gum in the ASA size emulsion, and thus, the effect of the ASA size emulsion in the paper product.

BRIEF DESCRIPTION OF THE FIGURE

These and other objects and advantages of the invention will be better appreciated and understood by those skilled in the art when the following description is read along with the accompanying drawing of which:

FIG. 1 is a graph illustrating the hydrolysis of the ASA , (i.e., improved chemical stability) from an anhydride to an acid form comparing a formulation of the present invention comprising guar gum to that of the prior art comprising a vinyl addition polymer as the ASA emulsifying agent.

DETAILED DESCRIPTION OF THE PREFERRED EMBODIMENTS

As used herein, the term "effective amount" of natural gum refers to the quantity of natural gum needed to bring about a desired result such as, for example, the quantity needed to improve the performance of the ASA size in the manufacture of paper products.

The ASA sizes to which this invention is applicable include those mentioned in U.S. Pat. Nos. 3,102,064, 4,040, 900, 3,968,005 and 3,821,069, all of which are hereinafter incorporated by reference.

The ASA sizes useful in the emulsion of the invention are generally described by the following structural formula:

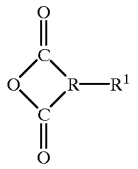

wherein R represents a dimethylene or trimethylene radical, and wherein $R^1$ is a hydrophobic group containing more than 5 carbon atoms which may be selected from the group consisting of alkyl, alkenyl, aralkyl or aralkenyl groups.

The terms "hydrogel", "protective colloid", and "hydrocolloid" are often used as descriptive terminology for a gum. These terms refer to the water swellable or viscosity modifying properties of gum, and also can describe properties of other naturally occurring materials and some petroleum-based polymers. A natural gum as defined herein denotes a group of naturally occurring materials, generally classified as polysaccharides, or their derivatives that hydrate in water. Natural gums are extracted from seaweed, plants, seeds, roots and by microbial fermentation. Natural gums can be classified by origin, such as Algal, Botanical (seed gums and plant extracts), and Microbial.

Several examples of these classifications are:

Algal: agar, algin, carrageenan

Botanical:

Seed: guar, locust bean, tamarind

Plant extracts: ghatti, tragacanth, karaya

Microbial: dextran, xanthan, gellan

A natural gum used in the invention may be selected from the group consisting of acacia, agar, algin, carrageenan, cellulose, damar, dextran, dextrin, flax, gelatin, gellan, guar, jalap, karaya, kelp, locust bean, olibanum, pectin, psyllium, rhamsan, sandarac, tamarind, tragacanth, welan, and xanthan, and blends thereof. The natural gum used in the invention preferably will not include materials that are understood to be starches. Most starches are a mixture of two polysaccharide types, i.e., amylose, an essentially linear polymer and amylopectin, a highly branched polymer. Starch, $(C_6H_{10}O_5)_n$, is obtained from seeds such as corn, wheat and rice or tubers such as potatoes.

The gum used in the invention may be in its natural state or it may be derivatized. Some of the derivatized gums include, but are not limited to, oxidized, carboxymethylated, hydroxyalkylated, quaternized ethers, and combinations thereof. The charge on the natural gum used in the invention may be nonionic, anionic, cationic or amphoteric.

A preferred embodiment of the invention provides an effective amount of gum comprised from the family of galactomannan gums. These are carbohydrates containing galactose and mannose as the structural building blocks. Examples of galactomannan gums are guar gum and locust bean gum. Generally, guar gum is a water-soluble natural polymer derived from the endosperm of the seed from the pod bearing legume cyamopsis tetragonolobus and psoraloides known to grow in India, Pakistan, and the United States. The charge of an unmodified guar gum is nonionic. A variety of performance characteristics (i.e., electrolyte compatability, biodegradabilitiy, rheology, etc.) can be assigned to the guar through the addition of functional groups. Examples of the functional groups and their impact on the charge properties of the guar are:

Anionic: carboxymethylated

Nonionic: oxidized and hydroxyalkylated

Cationic: quaternary amine

The ratio of the ASA size to natural gum in the emulsion of the invention, preferably, will range from about 0.01:1 to about 100:1, and more preferably, from about 0.1:1 to about 20:1. A surfactant may be added to the formulation to further improve the physical stability of the emulsion. The ASA size formulation according to the teachings of the invention may be applied to the paper pulp slurry as an emulsion containing a solids content ranging between about 0.1 to about 20.0 weight percent of ASA, where the solids content would contain the ratios of ASA size to natural gum as taught hereinabove. The amount of ASA size applied to the paper or paperboard preferably will range from about 0.25 lb./ton to about 10 lbs./ton, and more preferably from about 2 lbs./ton to about 8 lbs./ton of finished paper product.

The natural gum used in the invention may be in the form of dry powder or aqueous solution. In order to employ the natural gum of the invention in the emulsification of ASA sizes, an aqueous solution of the natural gum may be prepared. This aqueous solution may be added to the ASA or the ASA may be added to the aqueous solution of the natural gum.

A second embodiment of the invention, in addition to a natural gum, provides for the addition of a surfactant or other emulsifying agent to the ASA size formulation. Preferably, this additional component will synergistically work with the natural gum to: 1) decrease the amount of energy required to produce a stable emulsion; 2) increase the physical stability of the emulsion by decreasing the size of the emulsion droplets; and 3) increase the chemical stability of the emulsion over time.

For the first embodiment of the invention comprising the ASA and natural gum, the ASA emulsion mixture added to the pulp slurry according to the invention will preferably contain about 60% to about 99% by weight, of water, based on the weight of the mixture; about 0.1% to about 20% by weight, of ASA, based on the weight of the mixture; and about 0.01% to about 20% by weight, of natural gum, based on the weight of the mixture. More preferably, this emulsion will contain about 80% to about 99% by weight, of water, based on the weight of the mixture; about 1% to about 10% by weight, of ASA, based on the weight of the mixture; and about 0.01% to about 10% by weight, of natural gum, based on the weight of the mixture.

In order to obtain the ASA emulsion of the invention, the ingredients may be mixed by an agitation device, e.g. a mixing pump, so that the ASA particle size in the emulsion ranges from about 0.1 microns to about 10 microns in size.

The following examples demonstrate the effectiveness of the ASA emulsion of the present invention.

EXAMPLE 1

A standard fine paper furnish was prepared. The paper furnish had the following components and conditions:

(50/50) wt. % fiber [bleached hardwood kraft/softwood kraft]

10 wt. % ground calcium carbonate 10 wt. % precipitated calcium carbonate

Freeness=500 CSF

Consistency=0.5 wt. %

An emulsified ASA was prepared as follows:

1% solution of nonionic guar gum (J-2204 available from Rhone-Poulenc) was prepared in a standard laboratory mixer by adding the guar gum in dry powder form to water. An aliquot of this solution was added to a small Waring® blender. Alkenyl succinic anhydride (ASA) size obtained from Dixie Chemical under the trade name ASA 100 was added to the blender. Additional tap water was added to the blender. The ratio of the ASA size to nonionic guar gum was 10:1. The water, the ASA size, and the nonionic guar gum were blended for two minutes until the particle size of the components was about 1 micron based on microscopic inspection.

An aliquot of the above standard fine paper pulp furnish was mixed in a one liter glass container. The mixing sequence was as follows:

t=0 seconds—Mixer turned on to mix pulp furnish t=5 seconds—ASA size emulsion added t=15 seconds—Cation retention aid added t=30 seconds—Slurry poured into handsheet mold The amount of ASA size added to the pulp furnish was 5 lbs of ASA size per ton of finished paper. The amount of cationic retention aid added to the mixture was 0.5 lbs polymer/ton of finished paper. A handsheet was made, pressed, and dried on a rotary drum drier. The sample of fine paper formed therefrom was cured in an oven at 105° C. for 5 minutes.

In general, sizing is tested by using a Hercules™ Size Tester (HST) instrument. This instrument tests the sheet for acid ink penetration. The instrument generally is set at 80% reflectance, with 1% formic acid and 1.2% napthol green test ink. The HST values represent the time (in seconds) it takes for the ink solution to saturate the sheet. The longer the period of time, the better the sizing.

The sizing efficiency of the ASA sizing emulsion of this Example 1 which comprised water, ASA size, and nonionic guar gum, was determined by making hand sheets and then testing the hand sheets for HST values. The procedure involved the following: The freshly made emulsion was initially tested at zero hours. An aliquot of the fine paper furnish slurry with the emulsion was taken every hour for a total of five hours and a hand sheet was made. The HST values for the hand sheets prepared with the emulsion of the invention were then compared to the HST values of hand sheets prepared with an emulsion of the prior art. This emulsion of the prior art was similar to that of the above-discussed U.S. Pat. No. 4,657,946 and was comprised of a cationic vinyl addition polymer, ASA size, water, and a surfactant.

The results are show in Table 1 below. The HST values are an average of the felt side (FS) and the wire side (WS) of the hand sheet.

TABLE 1

HST Values of Prepared Hand sheets

| Time (hrs.) | Invention Average HST (sec.) | Prior Art Average HST (sec.) |
|---|---|---|
| 0 | 57.0 | 64 |
| 1 | 65.7 | 51 |
| 2 | 64.7 | 69.0 |
| 3 | 50.8 | 1.0* |
| 4 | 54.1 | |
| 5 | 58.6 | |

*Emulsion Separated after 3 hours

Table 1 shows that the ASA sizing emulsion of the present invention has HST values comparable to the HST values of the ASA sizing emulsion of the prior art for the first two hours. This demonstrates that both emulsions have comparable sizing efficiency for at least the first two hours. However, the third hour shows that the ASA sizing emulsion of the prior art separates; whereas, the HST values for the ASA sizing emulsion of the invention remains relatively high, i.e. comparable to the HST values for the first two hours, which indicates that the improved ASA sizing emulsion of the invention is more stable for a longer period of time compared to that of the prior art.

After 30 days, the same hand sheets prepared in accordance with the teachings of the invention were again tested to determine the long-term effectiveness of the size in the sheets. The HST values are shown in Table 2.

TABLE 2

HST Values of the Invention After 30 Days

| Time (hrs.) | Initial Average HST (sec.) | 30 Days Average HST (sec.) |
|---|---|---|
| 0 | 57.0 | 45.9 |
| 1 | 65.7 | 48.7 |
| 2 | 64.7 | 71.6 |
| 3 | 50.8 | 54.2 |
| 4 | 54.1 | 58.0 |
| 5 | 58.6 | 61.2 |

Based on the average HST values in Table 2, it appears that after 30 days, the effectiveness of the size in the hand sheets incorporating the ASA sizing emulsion of the invention was retained.

EXAMPLE 2

Table 3 lists several natural and derivatized guar gums used in preparation of ASA emulsions using conditions similar to that of Example 1. The guar gums were supplied by Rhone-Poulenc and are from their Jaguar product line. Hand sheets were made in a similar manner to that of Example 1. The furnish was 100% recycled fiber. Table 3 indicates the average HST values at 0-hours for the felt side (FS) and the wire side (WS) of the hand sheets. The amount of ASA size used in these hand sheets was 5 lbs./ton of finished paper.

TABLE 3

HST Values of Various Guar-ASA Emulsions Using Recycled Fiber

HST Values Of Various Guar-ASA Emulsions

| Jaguar Product | Guar Type | HST (FS) | HST (WS) | HST (Avg.) |
|---|---|---|---|---|
| CP-13 | Cationic | 61.6 | 71.1 | 66.4 |
| 2610 | Nonionic | 75.1 | 59.3 | 67.2 |
| 2638 | Nonionic | 54.4 | 40.2 | 47.3 |
| 8600 | Anionic | 77.5 | 46.2 | 61.9 |
| 2204 | Nonionic | 73.0 | 82.9 | 78.0 |

The HST average values for these guar gum products in Table 3 demonstrate the ability of a variety of natural and derivatized guar gums, with cationic, anionic, and nonionic functional groups, to produce the desired sizing performance.

Determination of Hydrolytic Stability Of The Emulsions

The hydrolytic stability of the ASA size emulsions of the invention, i.e., that containing a nonionic guar gum (J-2204) of Examples 1 and 2 and that of the prior art discussed in Example 1 was studied by a High Performance Liquid Chromatography (HPLC) method. The ASA was separated by a column into its hydrolyzed and its non-hydrolyzed components. The column used for this separation was a Phenomenex Prodigy C-18 column. The mobile phase, which is a mixture of water and acetonitrile at pH 3, was run under gradient conditions. The flow rate was 1.5 ml/min. at 25° C. with the ultra violet (UV) detector set at a wavelength of 220 nm. Peak areas were used to determine the amounts of hydrolyzed and non-hydrolyzed ASA.

By the HPLC method, the conversion of the ASA, in an aqueous environment, through hydrolysis of the anhydride into a diacid was observed. Generally, it is known that the acid form of ASA is a very poor sizing agent FIG. 1 shows this conversion of the ASA size after emulsification. After 6 hours, there is still a large percentage of anhydride remaining in the emulsion containing the nonionic guar gum of Examples 1 and 2. In contrast, the percentage of anhydride in the emulsion comprising the cationic vinyl addition polymer of the prior art of Example 3 was significantly less over the same period. The guar gum emulsion of the invention exhibits much more hydrolytic stability than the emulsion of the prior art. This may explain the ability of the emulsion of the invention to stand for longer periods and still retain its sizing efficiency.

EXAMPLE 3

Based on the techniques developed in the laboratory, the preparation of the ASA size emulsion of the invention comprising nonionic guar gum was scaled up to pilot sized equipment. The pilot equipment consisted of a Silverson homogenizer, which was fitted with a round-holed mixing head and which was mounted on 100 gallon tank. This unit was also fitted with a funnel apparatus for chemical addition and was capable of mixing speeds up to 3600 rpm. About 0.4% solution of nonionic guar gum (J-2204 available from Rhone-Poulenc) was prepared by adding 760 grams of nonionic guar gum in 48 gallons of water in a make-down tank. The homogenizing unit was set at the desired speed, and the 0.4% solution of guar gum was added to the homogenizing unit via the funnel apparatus. The homogenizing unit was set at the speeds (rpm) shown in Table 4. At five-minute intervals, samples were collected and the Brookfield viscosity of the samples was measured using a Brookfield low viscosity (LV) spindle No. 2 @ 60 rpm. The Brookfield viscosity (cps) values are indicated in Table 4 for mixing speeds of 2400, 3000, and 3600 rpm.

TABLE 4

Brookfield Viscosity (cps) Of Gum Solution

| Homogenization Time (min.) | Mixing Speeds @ 2400 rpm | @ 3000 rpm | @ 3600 rpm |
|---|---|---|---|
| 5 | 85 | 98 | 130 |
| 10 | 203 | 215 | 253 |
| 15 | 250 | 278 | 308 |
| 20 | 280 | 305 | 323 |
| 25 | 298 | 315 | 323 |
| 30 | 311 | 319 | 320 |

Example 3 was performed to determine the amount of time required to completely hydrate the gum used in the ASA sizing emulsion of the invention. A maximum in Brookfield viscosity is used as a gauge to predict the time required to achieve full hydration of the guar powder. Based on the results in Table 4, it is believed by the inventors that a mixing head speed of 3600 rpm for fifteen minutes should sufficiently hydrate the guar gum prior to emulsification with the ASA size of the invention.

EXAMPLE 4

Example 4 was performed to determine the effect a surfactant will have when used with guar gum as an ASA emulsifying agent in accordance with the teachings of the invention. It is believed that the use of a surfactant generally will result in a smaller particle size and will provide longer physical and chemical stability of the emulsion of the invention.

The pilot sized equipment of Example 3 was used in Example 4. About 0.4% solution of nonionic guar gum (J-2204 available from Rhone-Poulenc) was prepared by adding 760 grams of nonionic guar gum to 48 gallons of tap water which was then metered into a make-down tank. The homogenizing unit was set at 3600 rpm, and the 0.4% solution was mixed for 15 minutes. When desired, a surfactant, which was a phosphate ester surfactant (Rhodafac PE-510 from Rhone Poluenc), in the amount of 150 grams or 2% based on the amount of ASA size, was added to produce several test samples. The neat ASA size (7.6 kg) was added to the make-down tank via the funnel apparatus to form about 4% solution based on the amount of ASA size in the tank. Samples were collected at 10 minute and 20 minute intervals for a total time of 20 minutes. The hydrolytic stability of the ASA size emulsions was studied by high performance liquid chromatography (HPLC) as discussed hereinabove.

The guar gum/ASA size emulsion was used with 100% recycle liner furnish stock to make hand sheets via standard techniques.

The hand sheets were subjected to a Cobb Test (TAPPI Test Methods: T4410M90) which is a measure of water absorptiveness of paper and paperboard. The units for the Cobb Test is grams of water absorbed per 100 $cm^2$ of paper or paperboard sheet. Generally, the lower the Cobb values, the lower the water absorptiveness in the sheet. The procedure used for this test was as follows:

1 Prepare hand sheet via standard techniques.

2. Cure hand sheet in drying oven at 100° C. for 5 minutes.

3. Remove hand sheet from oven and let cool for 5 minutes.

4. Cut out 5.5×5.5 inch square from hand sheet.

5. Measure and record weight of square.

6. Secure square to Cobb Test instrument with felt side up.

7. Simultaneously add 150 mls of 50° C. water to the apparatus and start stopwatch.

8. At the 165 second mark, pour off water and gently blot the square dry.

9. Measure and record weight of square.

10. Subtract value in Step 5 from that of Step 9 to determine the degree of water absorption.

Lower Cobb values indicate better sizing performance. Cobb values less than 0.6 generally indicate an acceptable paper product. Cobb values ranging between 0.6 and 0.8 generally indicate marginally acceptable paper products. Cobb values greater than 0.8 generally indicate an unacceptable paper product.

Table 5 shows the results for the samples containing a surfactant and those containing no surfactant.

TABLE 5

Homogenization Time/Surfactant Use Study

| Variable | Homogenizing Time (minutes) | Sample Age | % Anhy-dride | Cobb @ 1.0 Hrs | Cobb @ 18.0 Hrs |
|---|---|---|---|---|---|
| No Surfactant | 10 | 0.5 hrs | 100 | 0.44 | 0.36 |
| 2% Surfactant | 10 | 1.5 hrs | 100 | 0.46 | 0.39 |
| No Surfactant | 20 | 1.0 hrs | 100 | 0.35 | 0.36 |
| No Surfactant | 20 | 4.1 hrs | 100 | — | — |
| No Surfactant | 20 | 21.0 hrs | 56 | — | — |
| 2% Surfactant | 20 | 2.1 hrs | 100 | 0.32 | 0.32 |

TABLE 5-continued

Homogenization Time/Surfactant Use Study

| Variable | Homogenizing Time (minutes) | Sample Age | % Anhy-dride | Cobb @ 1.0 Hrs | Cobb @ 18.0 Hrs |
|---|---|---|---|---|---|
| 2% Surfactant | 20 | 4.2 hrs | 100 | — | — |
| 2% Surfactant | 20 | 19.0 hrs | 89 | — | — |

As discussed hereinabove, ASA will hydrolyze from an anhydride to an acid when mixed with water. The higher the % anhydride, the longer the emulsion will be efficient and not generate deposits. The HPLC method 10 essentially measures the chemical stability of an emulsion versus time.

The data in Table 5 seems to indicate that 20 minutes is a sufficient homogenization time, and that the use of a surfactant may be beneficial to the stability of the guar gum/ASA emulsion of the invention. A surfactant may aid in the development of an emulsion of fine particle size, and may be more resistant to hydrolysis, thus, reducing deposit formation.

EXAMPLE 5

Example 5 was performed to determine the effectiveness of using other natural gums in an ASA size emulsion of the invention in a paper product. The pilot equipment of Example 3 was used for Example 5 and the experiments were conducted similar to that described in Example 3. The ratio of the ASA size to the natural gum was 10:1 to form about 4% ASA solution, based on the amount of ASA size in the tank. The water, the ASA size, and the natural gums which are listed in Table 6 were mixed in the homogenizer unit for an additional 20 minutes at 7500 rpm.

TABLE 6

| GUMS | Initial COBB Value (unaged emulsion). |
|---|---|
| None (Blank) | 1.72 |
| Agar | 0.35 |
| Dextrin | 0.34 |
| Pectin | 0.34 |
| Tragacanth | 0.32 |
| Xanthan | 0.30 |

Hand sheets were prepared with 100% recycle liner furnish and were subjected to the Cobb Test (TAPPI Test Methods: T4410M90) as discussed in Example 4. From the results in Table 6, it can be seen that the Cobb values are acceptable.

EXAMPLE 6

Tables 7 and 8 demonstrate the effectiveness for sizing and drainage performance of selected guars in an ASA formulation compared to prior art emulsions, such as that of the previously discussed U.S. Pat. No. 4,657,946, comprising a cationic vinyl addition polymer.

The ASA emulsions and hand sheets were prepared similar to that discussed in Example 1. The furnish was 100% recycled fiber. When used, the ASA dosage rate was 6 #/ton and Hydraid 6456I, a cationic retention aid sold by ECC, was used at a dosage rate of 3.5 #/ton dry fiber. The surfactants were phosphate esters obtained from Rhone-Poluenc. The surfactants comprised 1.5% of the ASA concentration in the emulsion formulation. Cobb tests were run as previously explained in Example 4 to determine sizing performance. Particle size of the emulsified ASA droplets were measured using a Malvern Mastersizer, manufactured by Malvern Instruments. Drainage tests were performed using a 500ml drainage tube run at 0.8% consistency.

TABLE 7

Emulsion Particle Size and Hand Sheet Sizing Performance

| Emulsifying Aid | Surfactant | Mean Particle Size (μm) | Initial Cobb Value (unaged emulsion). |
|---|---|---|---|
| None (Blank) | None | NA* | 1.75 |
| Cationic Vinyl addition polymer | GAFAC RE-410 | 1.12 | 0.31 |
| Jaguar 2204 | GAFAC RE-610 | 4.44 | 0.38 |
| Jaguar 8801 | GAFAC RE-610 | 2.50 | 0.44 |

*Too large to measure

TABLE 8

Drainage Performance Of Furnish Treated With Formulated ASA Emulsion

| ASA | Surfactant | Emulsifier | Retention Aid | Drainage Time (sec) For Specified Volume 50 mls | 100 mls | 150 mls |
|---|---|---|---|---|---|---|
| None (Blank) | No | No | No | 8 | 37 | 89 |
| Yes (Control) | No | No | Yes | 5 | 14 | 40 |
| Yes (Prior Art) | GAFAC RE-510 | Cationic Vinyl Addition polymer | No | 4 | 28 | 74 |
| Yes (Prior Art) | GAFAC RE-510 | Cationic Vinyl Addition polymer | Yes | 4 | 15 | 35 |
| Yes | GAFAC RE-610 | Jaguar 2204 | No | 6 | 32 | 84 |
| Yes | GAFAC RE-610 | Jaguar 2204 | Yes | 4 | 16 | 35 |
| Yes | GAFAC RE-610 | Jaguar 8801 | No | 6 | 32 | 78 |
| Yes | GAFAC RE-610 | Jaguar 8801 | Yes | 3 | 15 | 37 |

The Jaguar 2204 and 8801 products are nonionic guar gums. Jaguar 2204 is a natural underivatized guar and Jaguar 8801 is an oxidized hydroxypropyl derivatized guar. In Table 7, it is interesting to note that both nonionic guars were surprisingly effective in contrast to the prior art emulsion which tends to suggest that cationic materials may be required for effective performance. In addition, as seen in Table 8, the guar emulsified formulations of the invention offer a slight improvement in drainage over the control. It is expected that actual field trials on several paper machines producing paperboard from recycle furnish containing the ASA emulsion of the invention will show a dramatic increase in drainage.

While the present invention has been particularly set forth in terms of specific embodiments thereof, it will be understood in view of the instant disclosure, that numerous variations upon the invention are now enabled to those skilled in the art, which variation yet reside within the scope of the present teaching. Accordingly, the invention is to be broadly construed, and limited only by the scope and spirit of the claims now appended hereto.

What is claimed is:

1. An alkenyl succinic anhydride emulsion mixture comprising:

a) about 60% to about 99% by weight, of water, based on the weight of the mixture;

b) about 0.1% to about 20% by weight, of an alkenyl succinic anhydride, based on the weight of the mixture;

c) about 0.01% to about 20% by weight, of a natural gum, based on the weight of the mixture; wherein said natural gum is selected from the group consisting of acacia, agar, algin, carrageenan, cellulose, damar, dextran, dextrin, flax, galactomannin gums including guar gum and locust bean gum, gelatin, gellan, jalap, karaya, kelp, olibanum, pectin, psyllium, rhamsan, sandarac, tamarind, tragacanth, welan and xanthan, salts of said natural gums, derivative of said natural gums and blends of said natural gums; wherein said natural gum excludes starch; and d) optionally a surfactant, wherein the amount of said surfactant is based on the amount of alkenyl succinic anhydride present, such that the amount of surfactant is about 2% of the amount of alkenyl succinic anhydride .

2. The emulsion of claim 1 in which a surfactant is present.

3. In a process for the sizing of paper products using alkenyl succinic anhydride as the sizing agent, the improvement comprising using from about 0.25 lb./ton of finished paper product to about 10 lbs./ton finished paper product of an alkenyl succinic anhydride emulsion mixture as the sizing agent, wherein said alkenyl succinic anhydride emulsion mixture comprises:

a) from about 60% to about 99% by weight, of water, based on the weight of the mixture,;

b) from about 0.1% to about 20% by weight, of an alkenyl succinic anhydride, based on the weight of the mixture;

c) from about 0.01% to about 20% by weight, of a natural gum, based on the weight of the mixture; wherein said natural gum is selected from the group consisting of acacia, agar, algin, carrageenan, cellulose, damar, dextran, dextrin, flax, galactomannin gums including guar gum and locust bean gum, gelatin, gellan, jalap, karaya, kelp, olibanum, pectin, psyllium, rhamsan, sandarac, tamarind, tragacanth, welan and xanthan, salts of said natural gums, derivative of said natural gums and blends of said natural gums; wherein said natural gum excludes starch; and d) optionally a surfactant, wherein the amount of said surfactant is based on the amount of alkenyl succinic anhydride present, such that the amount of surfactant is about 2% of the amount of alkenyl succinic anhydride present.

4. The process of claim 3 in which a surfactant is present in the alkenyl succinic anhydride emulsion mixture.

* * * * *